United States Patent [19]

Fleischer et al.

[11] 4,441,758

[45] Apr. 10, 1984

[54] ADJUSTABLE FOOT SUPPORT

[75] Inventors: Willy Fleischer, Essen-Werden, Fed. Rep. of Germany; Alfred von Schuckmann, Kevenhonk 63, 4178 Kevelaer 2, Fed. Rep. of Germany

[73] Assignees: Willy Fleischer Metalwarenfabrik GmbH & Co. KG; Alfred von Schuckmann, both of Fed. Rep. of Germany

[21] Appl. No.: 288,177

[22] Filed: Jul. 29, 1981

[30] Foreign Application Priority Data

Jul. 8, 1980 [DE] Fed. Rep. of Germany ... 8021146[U]

[51] Int. Cl.[3] ..... A47C 9/12

[52] U.S. Cl. ..... 297/439; 248/371

[58] Field of Search ..... 297/439, 284, 363, 361; 5/74; 248/371, 397, 454

[56] References Cited

U.S. PATENT DOCUMENTS

| | | | |
|---|---|---|---|
| 277,544 | 5/1883 | Chappell | 248/371 |
| 2,850,081 | 9/1958 | Dillon | 297/439 |
| 3,653,715 | 4/1972 | Drabert et al. | 297/439 |
| 3,747,976 | 7/1973 | Lacey | 297/361 |
| 4,155,593 | 5/1979 | Swenson et al. | 297/284 |
| 4,296,694 | 10/1981 | Kobayashi | 297/439 |

*Primary Examiner*—Francis K. Zugel

*Attorney, Agent, or Firm*—McGlew and Tuttle

[57] ABSTRACT

An adjustable foot rest is disclosed which comprises a floor stand, a foot plate which is pivotally mounted to the floor stand for height and inclination adjustment and an apparatus interengaged between the floor stand and the foot plate for adjusting the inclination and height of the foot plate. A trackway is defined on the foot plate which receives a rotatable and slidably mounted actuating shaft. A rack is defined on the floor stand which is engaged with a pinion connected to the actuating shaft. The rack extends along a horizontal line and the trackway extends at an acute angle to the rack so that rotation of the shaft causes movement of the shaft along the rack which in turn moves the trackway with respect to the floor stand to adjust the height and inclination of the foot plate.

10 Claims, 8 Drawing Figures

ADJUSTABLE FOOT SUPPORT

FIELD AND BACKGROUND OF THE INVENTION

The present invention relates in general to foot rests and, in particular to a new and useful foot support which is adustable in height and in inclination.

With the introduction of electronic data processing technology (EDP), the posture of workers of operators of data processing equipment, when seated, and the design of the seats and the work place itself, have gained increasing importance. These considerations apply particularly to work places which utilize video or similar display devices plus keyboards. Operators of such equipment spend long hours in a seated position so that the design of furnishings of such work places must take a number of erogonomic aspects into account. Special adaptation must be provided for between a person's physical and psychic functionings, and the video and keyboard equipment he or she must operate. Such considerations include not only the arrangement of the video screen and keyboard and the desk and chair design, but also a footrest for supporting the feet of the seated operator. Such a footrest or footplate must be adjustable both in height and inclination to permit any operator of the equipment to assume the correct position for their job.

SUMMARY OF THE INVENTION

Accordingly, it is an object of the present invention to provide a footrest which is adjustable both in height and in inclination, in a simple manner, so that an operator can easily and quickly adjust their own footplate to their particular desired height and inclination.

Accordingly, the invention provides a foot rest wherein an actuating shaft which is adjustable in a horizontal plane is mounted in a floor stand with at least one pinion connected to the actuating shaft engaging a horizontal rack on the floor stand. The shaft extends into an elongated guide hole or trackway on a footplate which is pivotally mounted to the floor stand. The trackway extends in a direction of motion of the actuating shaft, and at a selected vertical inclination with respect to the horizontal. Operating means such as a handle are connected to the actuating shaft for moving the shaft. The inclination and height of the footplate is thus adjusted with respect to the floor stand by actuating and moving the actuating shaft in a horizontal plane. The degree of height and inclination adjustment depends on the length of the elongated guide hole or trackway, on the footplate, and on the degree of inclination of this elongated guide hole with respect to the horizontal rack on the floor stand. When the actuating shaft is at one end of the elongated guide hole, the foot plate rests directly on the floor stand. When the actuating shaft is at an opposite end of the hole, or trackway, the greatest height adjustment is attained for the foot plate, and the footplate attains its greatest angle of inclination.

Accordingly, an object of the present invention is to provide an adjustable footrest which comprises a floor stand, a footplate pivotally mounted to the floor stand for height and inclination adjustment, a trackway defined on the footplate, an actuating shaft movably mounted to the trackway for movement therealong, a rack defined on the floor stand at an angle to the trackway to which the shaft is engaged, and operating means connected to the actuating shaft for moving the actuating shaft on the rack and on the trackway to adjust the inclination and height of the footplate.

According to one feature of the invention, the floor stand includes side legs or members. The foot plate is hinged to one end of these side legs. Opposite ends of the side legs carry one or more racks which are engaged by pinions connected to the actuating shaft. The actuating shaft is thus mounted on the racks and still engaged in the trackway of the footplate. For a better engagement of the pinions and the racks at all times, at least one hold-down member crosses the actuating shaft and is mounted on the floor stand for holding the actuating shaft, and thus the pinions down against the associated racks. The hold-down member may be designed in the form of a leaf spring which is wrapped over the shaft. A spring may also be connected between one end of the spring and the floor stand to provide a biasing force for pushing the shaft pinions against their associated racks. In this manner it is not only the pinions of the actuating shaft which are being pushed down on the rack by the spring loaded hold-down member, but in addition, a toe area of the footplate is spring-loaded via the actuating shaft against the floor stand in a return direction. Thus, raising the footplate while increasing its angle of inclination counters the spring load.

According to another feature of the invention, the actuating shaft includes two bearing plates positioned on either side of each pinion for centering the pinion on the rack which is engaged between the bearing plates. The pinion may also be formed by two or more bolts which are connected between the bearing plates in a polygonal arrangement or along a line, so that the bolts act as teeth of the pinion to engage the teeth of the racks. This pinion design thus provides, at the same time, a radial bearing for the actuating shaft, which thus cannot move axially with respect to the rack due to the presence of the bearing plates, and a horizontal movement of the shaft along the racks. According to a preferred form of the invention, the footplate includes cheeks or side members which overlap the side legs of the floor stand. The elongated guide hole or trackway is defined in these cheeks. The ends of the actuating shaft penetrates through the elongated guide hole and a star shaped knob is connected to the actuating shaft outside the footplate for rotation and translation of the footplate along the rack. The knob may be operated by the user's foot, with the star-shaped knob extending from only one end of the shaft. A hygienically unobjectionable adjustment of the footrest can thus be achieved which does not require the operator to utilize his hands.

Advantages of the invention are that the height and inclination of the footrest is adjustable and the footrest itself is simple in design, rugged in construction and economical to manufacture, while being quick and easy to adjust.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
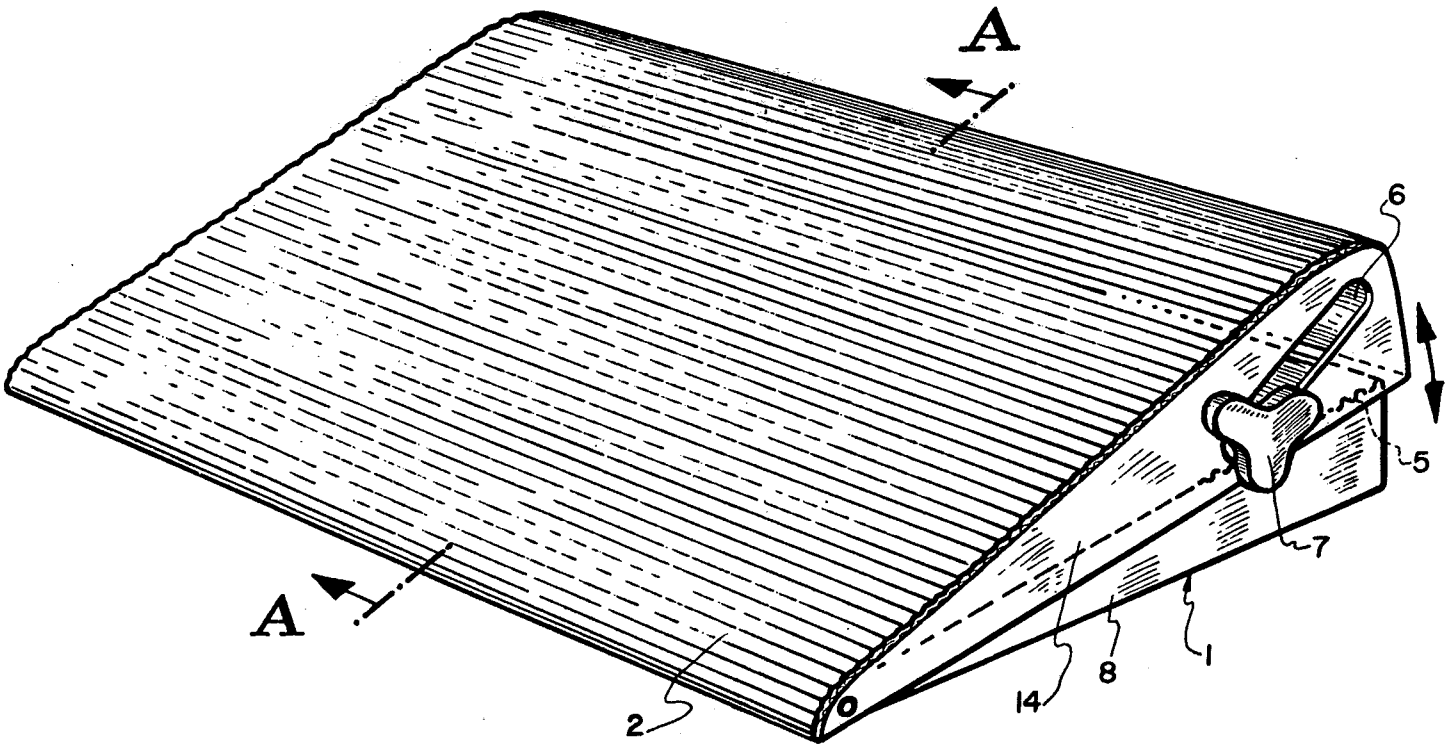
FIG. 1 is a top perspective view of the foot rest according to the invention shown in a raised position.
Figure 2:
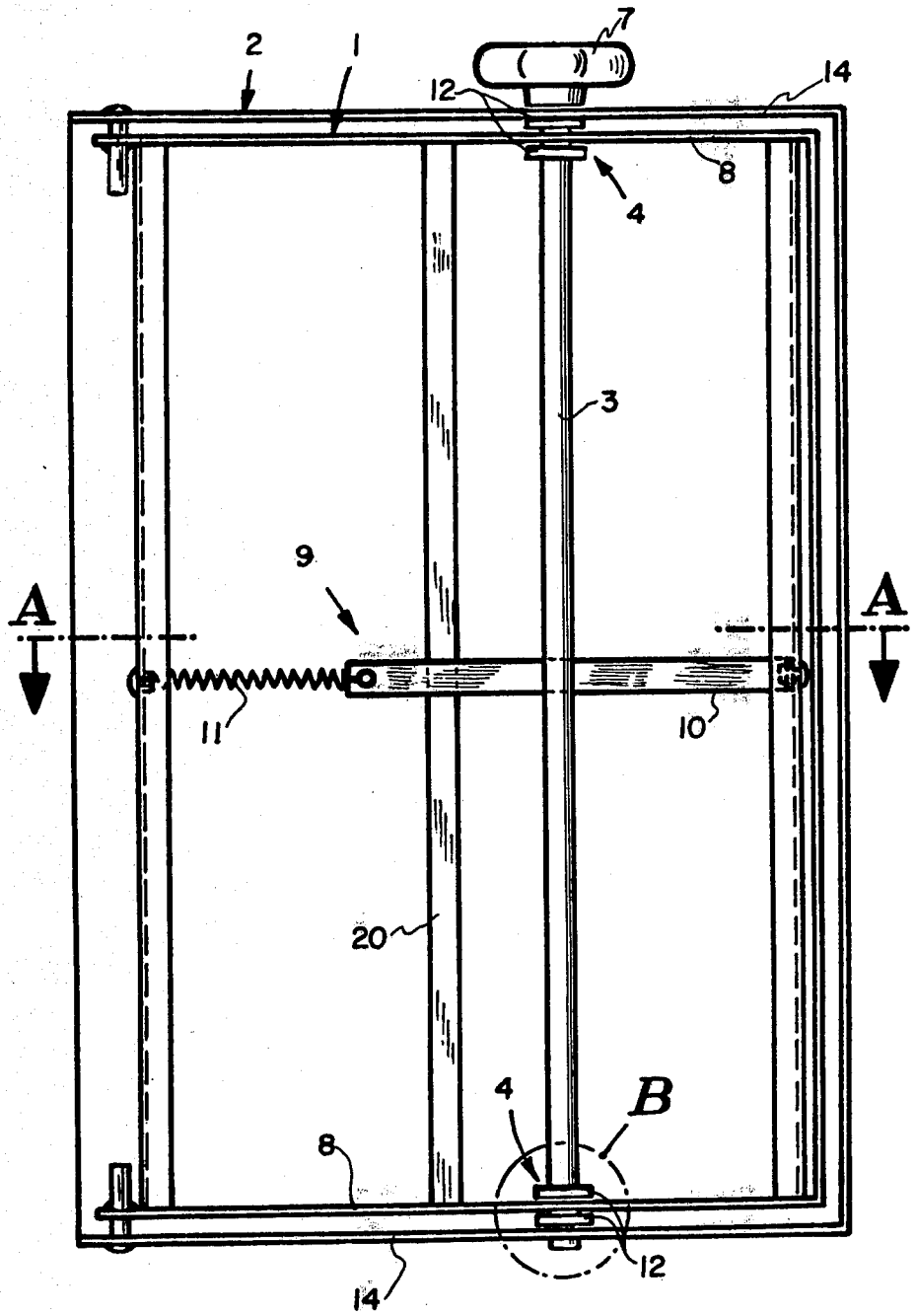
FIG. 2 is a bottom plan view of the footrest shown in FIG. 1.
Figure 3:
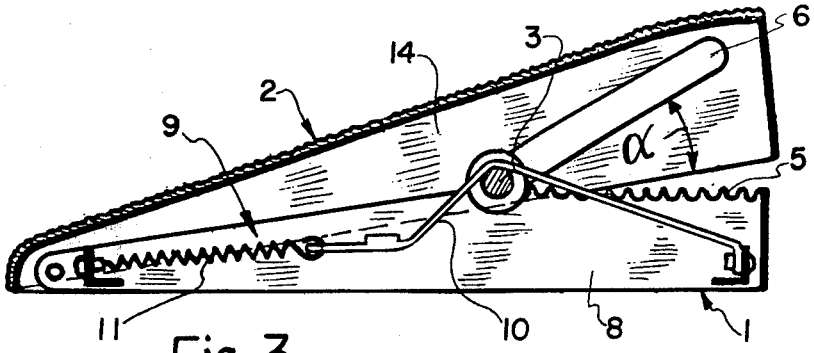
FIG. 3 is a sectional view taken along the line A—A of FIG. 1 showin the footrest in its fully raised position.
Figure 4:
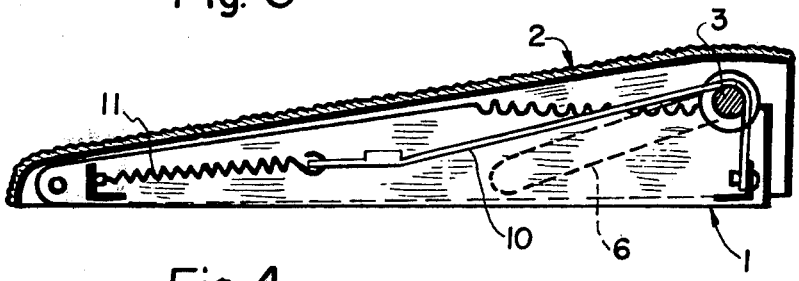
FIG. 4 is a view similar to FIG. 3 showing the footrest in its fully lowered position.
Figure 6:
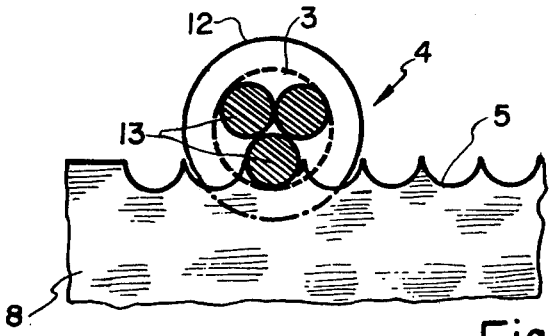
FIG. 6 is a sectional view partly in elevation taken along line C—C of FIG. 5.
Figure 5:
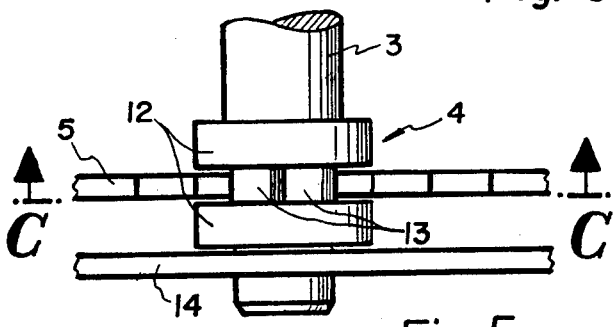
FIG. 5 is a top detail view showing an enlargement of the area labeled B in FIG. 2.

Turning to the drawings in particular, the invention embodied therein is a footrest which is adjustable both in height and in inclination in a simple manner using for example, a control member 7 which can be rotated.

The figures illustrate a footrest comprising a floor stand 1 and a height and inclination adjustable footplate 2, hinged thereto. Mounted in the floor stand 1 is an actuating shaft 3 which is movable and adjustable in the horizontal plane. At least one pinion 4 of the actuating shaft 3 engages a horizontal rack 5, and the actuating shaft 3 penetrates an elongated guide hole or trackway 6 on the footplate 2. Trackway 6 extends at a given vertical inclination alpha, to the direction of motion of the actuating shaft 3 along rack 5.

In the shown example, the actuating shaft 3 has a pinion 4 on both sides of the footplate 2, and the footplate 2 has an elongated guide hole 6 on both sides. In addition, the actuating shaft 3 has an operating means in the form of knob 7. The floor stand 1 has lateral legs or side members 8, to one end of each of which the footplate 2 is hinged and whose other ends form bearing means for the actuating shaft 3 or its pinion 4 in the shape of racks 5. Disposed in the floor stand 1 is at least one holddown member 9 crossing over the actuating shaft 3. The holddown member 9 may be designed as a simple leaf spring. In the embodiment example, the holddown member 9 comprises a spring arm 10, a bend in which crosses over the actuating shaft 3, and an extension spring 11 hooked to the spring arm, the respective far end of spring arm 10 and extension spring 11 being fastened to the floor stand 1. Each one of the pinions 4 mounted to the actuating shaft 3 in the area of its ends has two bearing plates 12 accommodating the associated rack 5 between them and two or more bolts 13 connecting the bearing plates 12 in a polygonal arrangement or along a line. A triangular arrangement according to this embodiment is shown for example.

The bolts engage rack 5 one after the other and thus act as teeth in the teeth of the rack. The footplate 2 has cheeks or side members 14 overlapping the lateral legs 8 of the floorstand 1 on both sides. The elongated guide holes 6 are disposed in these cheeks 14. The shaft ends of the actuating shaft 3 penetrate the elongated guide holes 6. Mounted to one shaft end as the operating means, is a star-shaped or triangular knob 7 for foot operation. A brace 20 hold a part of leaf spring 10 down as shown to aide its operation.

Figure 7:
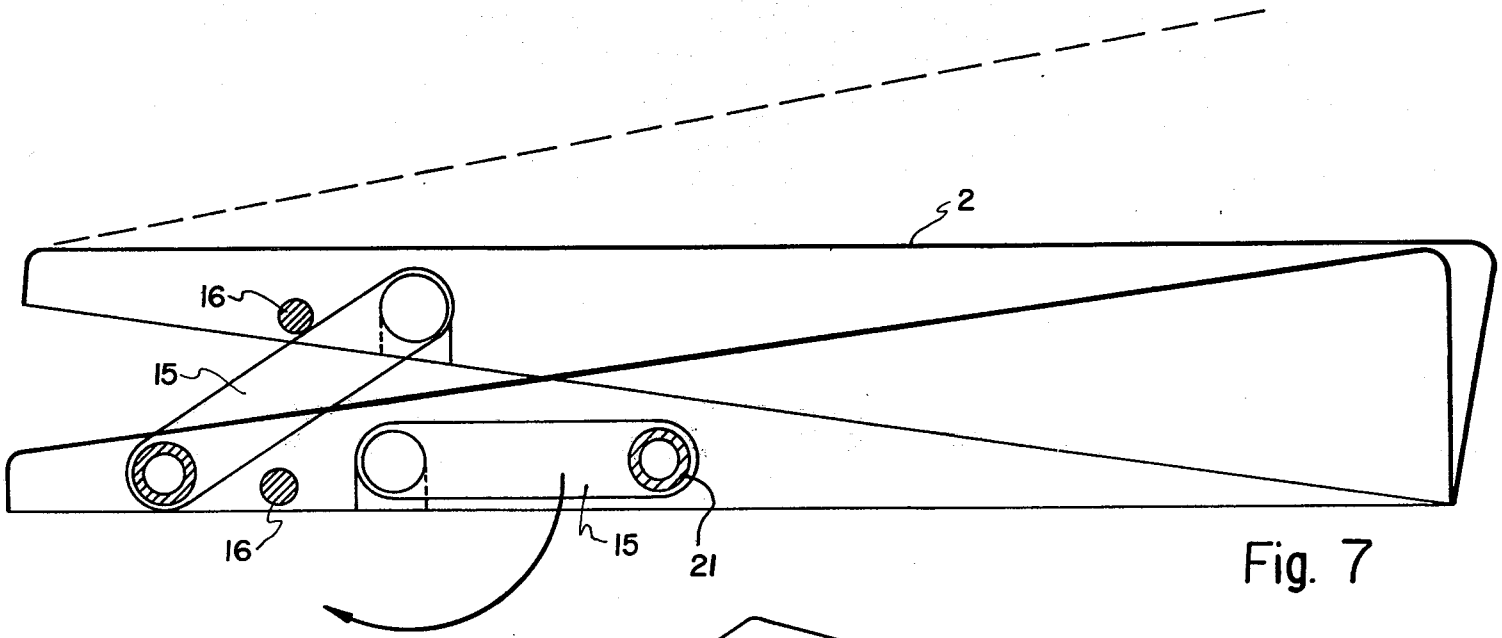
FIG. 7 is a simplified side sectional view of a modified form of the invention.
Figure 8:
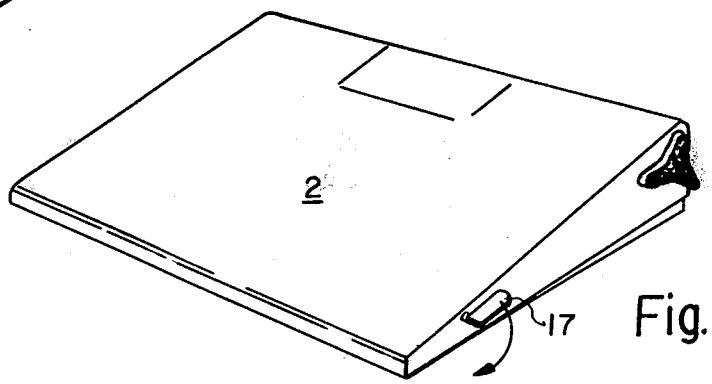
FIG. 8 is a simplified perspective view of the embodiment shown in FIG. 7.

According to a modified embodiment of the invention, an arm 15 such as a tubular arm, is pivotably mounted to the footplate 2 in the area of its front edge as shown in FIG. 7. In its swung-out position for height adjustment or horizontal positioning of the footplate 2, this tubular arm rests against a stop 16 on the footplate 2. For its operation, the arm 15 has a handle or foot lever 17 projecting laterally from the footplate 2. The end 21 of arm 15 rests on floor under the footrest so that the entire rest is raised by movement of arm 15.

While a specific embodiment of the invention has been shown and described in detail to illustrate the application of the principles of the invention, it will be understood that the invention may be embodied otherwise without departing from such principles.

What is claimed is:

1. An adjustable footrest comprising;
   - a floor stand;
   - a footplate pivotally mounted to said floor stand for height and inclination adjustment thereof;
   - a trackway defined on said footplate;
   - an actuating shaft movably mounted along said trackway;
   - a rack defined on said floorplate and extending at an angle to said trackway to which said shaft is engaged for movement therealong with simultaneous movement of said shaft along said trackway; and
   - operating means connected to said shaft for moving said shaft simultaneously along said rack.

2. A footrest according to claim 1, wherein said floor stand includes two side legs, said footplate pivotally mounted to one end of each of said side legs, said rack defined on an opposite end of one of said side legs and an additional rack defined on an opposite end of the other of said side legs, said actuating shaft including a pinion connected thereto engaged with each of said former mentioned and additional racks, said racks extending substantially horizontally and said trackway inclined at an angle to the horizontal.

3. A footrest according to claim 1, including holddown means engaged to said shaft and connected to said floor stand for holding said shaft down against said rack.

4. A footrest according to claim 3, wherein said holddown means comprises a leaf spring member connected at one end to said floor stand and extending over said actuating shaft for holding said actuating shaft down on said rack while permitting movement of said actuating shaft along said rack and along said trackway.

5. A footrest according to claim 4, including a spring connected between an opposite end of said leaf spring member and said floor stand for biasing said leaf spring member down against said actuating shaft.

6. A footrest according to claim 1, wherein said actuating shaft includes a pinion having teeth, said rack having teeth, said pinion teeth engaged with said rack teeth so that rotation of said actuating shaft causes movement of said actuating shaft along said rack and along said trackway, said pinion comprising a pair of bearing plates connected to said actuating shaft and positioned on opposite sides of said rack and a plurality of bolts extending between said bearing plates forming said pinion teeth, said bolts arranged in polygonal fashion for alternately meshing with successive teeth of said rack.

7. A footrest according to claim 1, wherein said foot plate includes side cheeks, said floor stand having side members overlapped by said side cheeks of said foot plate, said trackway comprising a pair of parallel elongated guide holes defined in each of said side cheeks respectively for receiving opposite ends of said actuating shaft.

8. A footrest according to claim 7, wherein said operating means comprises a star-shaped knob connected to one end of said actuating shaft extending out of one of said elongated guide holes, whereby an operator can rotate said knob using their foot.

9. A footrest according to claim 1, including an arm pivotally mounted to said footplate for pivotal movement beyond the extent of said floor stand, and a rest stop connected to said footplate engageable by said arm in its position extending beyond said floor stand for raising an end of said footplate and floor stand.

10. A footrest according to claim 9, including a lever connected to said arm extending outwardly of said footplate whereby said lever and arm can be rotated by an operator's hand or foot.

* * * * *